US007350785B2

(12) United States Patent
Lewis

(10) Patent No.: US 7,350,785 B2
(45) Date of Patent: Apr. 1, 2008

(54) TEST-CUTTING TARGET FOR EDGED-WEAPONS PRACTICE

(76) Inventor: George C. Lewis, 3838 Animas Way, Superior, CO (US) 80027

( * ) Notice: Subject to any disclaimer, the term of this patent is extended or adjusted under 35 U.S.C. 154(b) by 0 days.

(21) Appl. No.: 11/460,978

(22) Filed: Jul. 29, 2006

(65) Prior Publication Data

US 2008/0036153 A1 Feb. 14, 2008

Related U.S. Application Data

(63) Continuation-in-part of application No. 11/222,391, filed on Sep. 8, 2005, now abandoned, which is a continuation-in-part of application No. 10/769,020, filed on Jan. 29, 2004, now Pat. No. 7,293,777.

(51) Int. Cl.
*F41J 3/00* (2006.01)

(52) U.S. Cl. ..... 273/403; 273/348; 434/247

(58) Field of Classification Search ..... 273/403–410; 446/473, 486; 5/636
See application file for complete search history.

(56) References Cited

U.S. PATENT DOCUMENTS 4,328,966 A * 5/1982 Miyamoto ..... 446/473
4,773,107 A * 9/1988 Josefek ..... 5/636
4,916,765 A * 4/1990 Castronovo, Jr. ..... 5/640
5,219,163 A * 6/1993 Watson ..... 463/47.2
5,295,926 A * 3/1994 Tanabe ..... 482/12
5,324,227 A * 6/1994 Yuh-Ching ..... 446/473
5,630,998 A * 5/1997 Parsons ..... 434/11
5,904,970 A * 5/1999 Lauer et al. ..... 428/71
5,971,398 A * 10/1999 Broussard et al. ..... 273/408
6,010,435 A * 1/2000 Tanabe ..... 482/83
6,360,388 B2 * 3/2002 Langer ..... 5/632
6,449,788 B1 * 9/2002 Nichols ..... 5/636

* cited by examiner

*Primary Examiner*—Mark S Graham

(57) ABSTRACT

Improved targets suitable for cutting with an edged weapon are disclosed. In an embodiment the target is a prism made of polyethylene foam with a hole for receiving a peg and an external indicia alerting the practitioner of the depth of the hole and, thereby, what portion of the target may be cut without risk of cutting the peg. In an embodiment the target is comprises a polyethylene foam tube or rod with the exterior cylindrical wall covered by a sheath of material, such as paper, that prevents the foam from bending and thereby increases the rigidity of the target. An improved peg for receiving and positively, but removably, engaging a foam target is also disclosed.

14 Claims, 7 Drawing Sheets

TEST-CUTTING TARGET FOR EDGED-WEAPONS PRACTICE

RELATED APPLICATIONS

This application is a continuation in part of U.S. patent application Ser. No. 11/222,391 which is a continuation in part of Ser. No. 10/769,020, which applications are hereby incorporated herein by reference.

BACKGROUND

Martial arts, such as karate, tae kwon do, judo and aikido, have become popular in the United States and worldwide. Even less mainstream martial arts, such as jujitsu, kendo and krav maga, now have significant followings.

As these oriental arts have evolved, nearly all have begun to introduce weapons practice as part of the standard curriculum. One no longer needs to take a sword-oriented martial art such as kendo or iaido to receive instruction in the use of a Japanese sword as this instruction is now offered in other oriental martial arts including karate, jujitsu, aikido and even judo. In addition to the increase in weapons training in oriental martial arts, there has been a resurgence in interest in medieval and western martial styles through the Society for Creative Anachronism, renaissance festivals, fencing and the like, which has also added to the popularity of sword and edged weapons training.

One aspect of sword and edge weapons training that is gaining popularity is actual cutting of targets with real weapons. For example, one element of traditional Japanese sword training is called tameshigiri, or test cutting practice. In traditional tameshigiri, a swordsman practices his swing and posture by cutting a cylindrical target with a sword or other weapon. In traditional tameshigiri, the targets are typically made by rolling tatami omote (a woven rice mat) into a cylinder. Other target are young (i.e. wet) bamboo of various diameters, or cylindrical bails of straw.

Tameshigiri probably represents the most organized form of test cutting training. Its techniques and materials are borrowed by many other arts and styles for similar training. However, the materials and design of test-cutting targets as used in tameshigiri have several drawbacks. First, they are relatively expensive. At $3 to $5 per tatami omote mat, and targets made of 3 or more mats rolled together which are destroyed when used being common, the cost of extensive training is very high.

Second, the current materials and targets made therefrom are messy and require extensive clean up of the training area after practice. Typically a woven mat (tatami) target will partially separate after cutting, releasing a multitude of small individual lengths of straw or whatever the mat is woven out of in the practice area. These are difficult and time consuming to clean up.

Third, they are dangerous to the practitioner in that splinters and sharp edges may result during cutting. This is especially true as most martial arts require exponents to practice barefoot. Small slivers and pieces of target can injure the feet during practice.

Fourth, they can damage the weapons through scratches and abrasions to the cutting surface. This is especially true if 'used' tatami mats are made into targets. The used mats typically contain grains of sand and other particles that can scratch the highly polished weapons typically used in such practice. Furthermore, because of the mass of the traditional targets, a poorly executed by powerful cut may result in a bent sword. This makes cutting for beginners a potentially very expensive prospect.

Fifth, they require significant amount of preparation time—often requiring that they be assembled and then soaked in water for at least a day prior to using. The water often becomes foul and stains the vessel used for the soaking.

Sixth, the targets do not have the same cutting properties in different directions. For example, a woven tatami mat rolled into a long, cylindrical target is easily cut along its long axis, but hard to cut perpendicular to its long axis. All natural wood targets also exhibit this trait in one way or another. Cutting the target with the grain is easier than cutting against the grain. This is also a drawback when attempting to recreate kata when doing test cutting. For example, the first kata of most forms of Iaido is a seated form starting with a horizontal cut at the height of the opponent's neck and followed by a an vertical cut to the opponent's body. Because the cuts are in rapid succession to the same location, only a single target can be used. However, a typical target, because the properties are not uniform, is not suitable for such practicing this kata.

Seventh, the properties of the targets, because they are made from natural products such as wood and straw, change from one target to the next. Furthermore, the moisture content of a target has a very significant effect on the cutting properties of the target. These attributes make it difficult to gauge the power and effectiveness of one's cutting from target to target. This also poses a problem in competitions where one competitor can have targets with properties that differ significantly from other competitors' targets.

DETAILED DESCRIPTION

The specification discloses improved targets for cutting with edged-weapons, and improved stands and improved pegs for use in tameshigiri.

Figure 1:
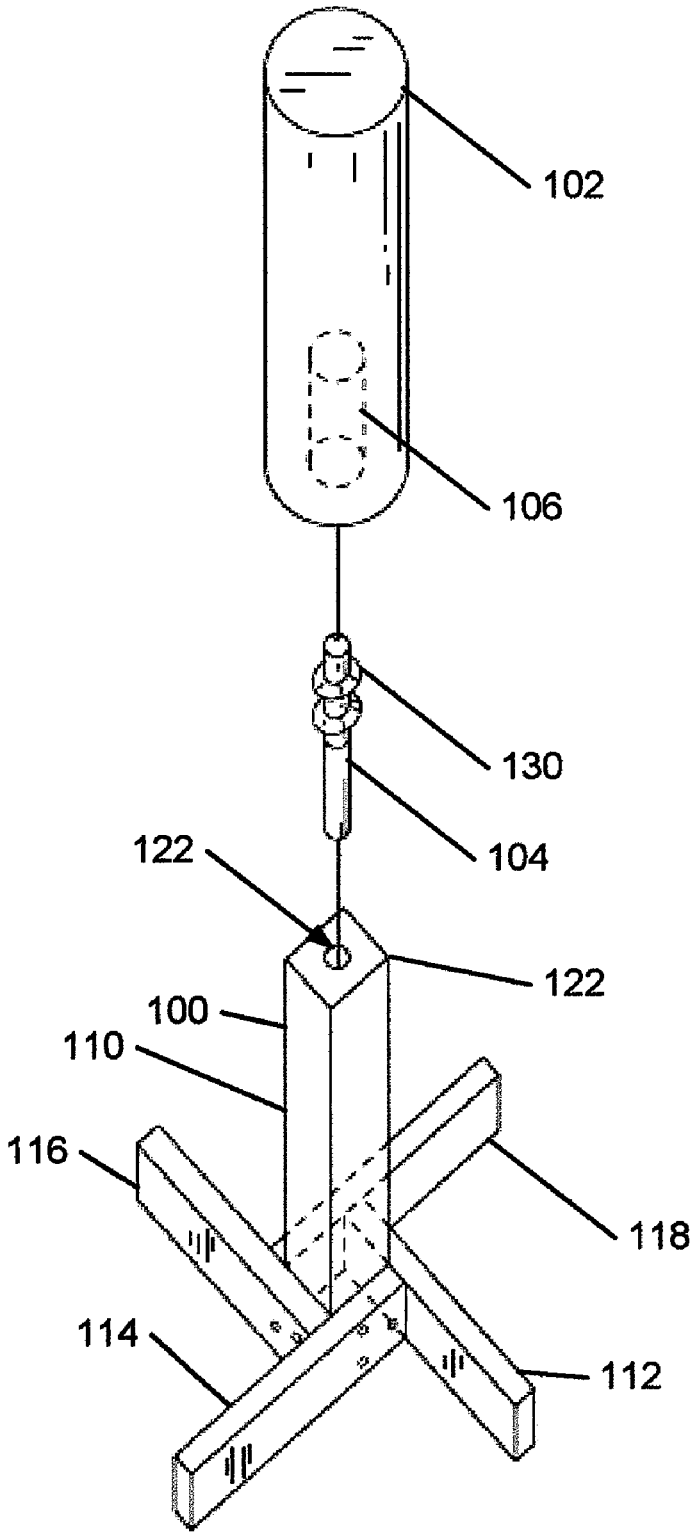
FIG. 1 shows an exploded stand and cutting target combination with an improved peg for use with a cutting target in accordance with embodiments of the present invention.

FIG. 1 shows an exploded view of an embodiment of a tameshigiri stand and cutting target in accordance with the present invention. A vertical stand 100 may be provided to which a rod target 102 may be vertically attached for practicing diagonal and horizontal cuts as targets 102 on this stand exhibit a vertical cutting surface. FIG. 1 shows a stand 100 comprising a vertical member 110, four horizontal members 112, 114, 116, 118 extending from a bottom end of the vertical member 110 to form a horizontal base. In the vertical member 110 at the end 122 opposite the base, the vertical member 110 is provided with a hole 120 for receiving a peg 104. The hole 120 may be sized to fixedly but removably retain the peg 120 and have a depth that allows at least some of the peg to extend above the end 122 of the vertical member 110. The end 122 of the vertical member 110 may include a flat surface upon which a target 102 rests when installed on a peg 104 that is likewise installed on the vertical member 110 as shown. In the embodiment shown in FIG. 1, the peg 104 is provided with threads or ribs 130 for positively engaging the target 102. The target 102 is provided with a hole 106 for receiving the peg 104. As discussed below, the hole 106 is sized to snugly fit onto the peg 104.

Figure 7:
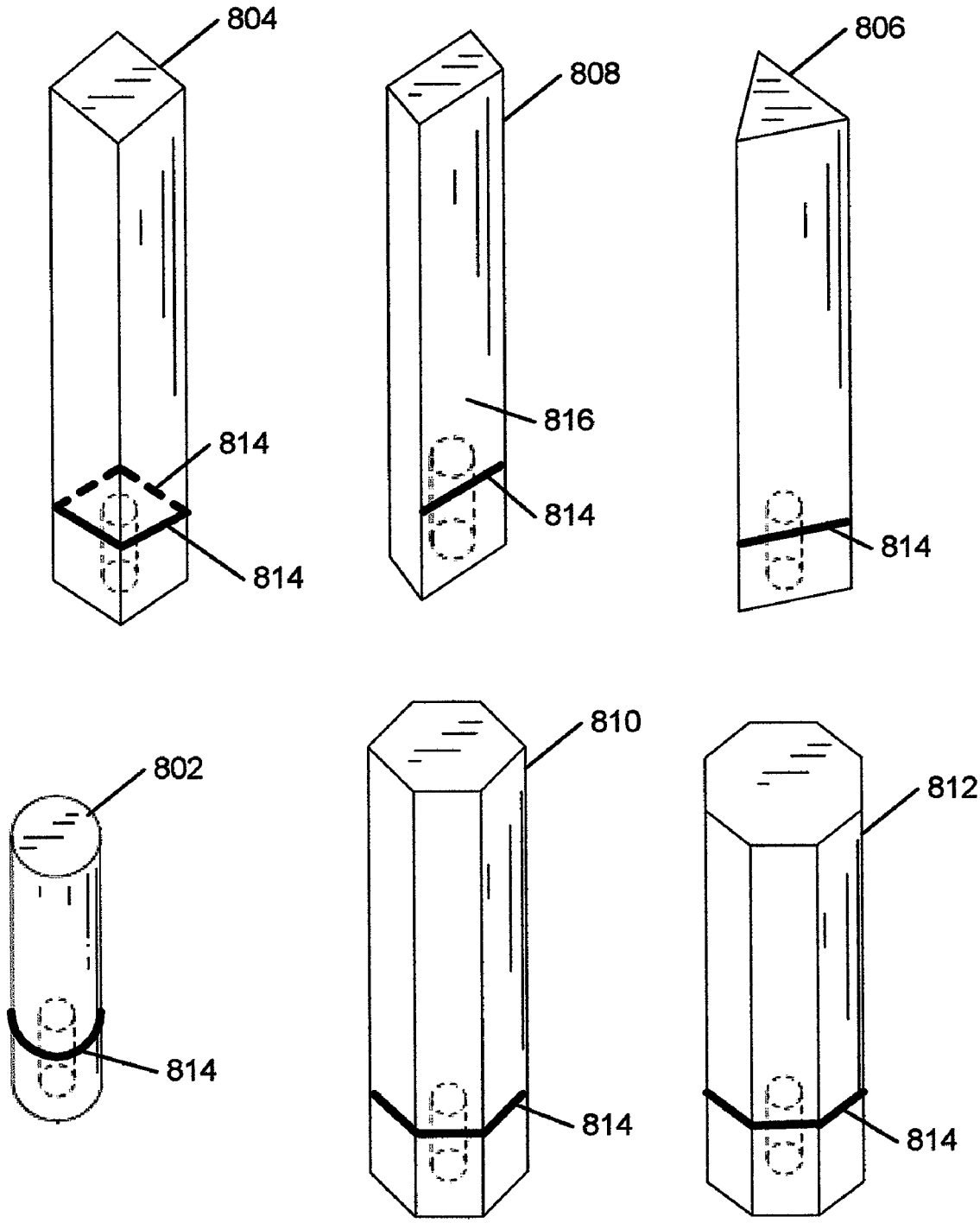
FIG. 7 illustrates several different embodiments of target geometries.

FIG. 7 illustrates several different embodiments of target geometries. Such alternative embodiments include targets that instead of a circular cross section 802 are long prism members having a square 804, triangular 806, rectangular 808, hexagonal 810, and octagonal 812 cross section.

Each target is illustrated with an indicia 814 to a practitioner of the approximate depth of the peg-receiving hole in the target body. The rectangular prism target 808 is illustrated with an indicia 814 in the form of a line on one face 816 of the prism. The square prism target 804, one the other hand is illustrated with an indicia 814 visible from all sides. Other indicia 814 may also be used, as discussed below.

Improved Targets Comprising Polyethylene Foam

Various densities of polyethylene foam were evaluated for suitability for use in test-cutting targets, such as the target 102 shown in FIG. 1. The testing included cutting closed cell polyethylene (PE) foam tubes and rods of nominal 1.7 pound per cubic foot density (pcf) and 2.2 pcf density and PE foam prisms of 2.2 pcf and 4.0 pcf. Suitable foams include closed-cell polyethylene foams such as those sold under Dow Chemical's Ethafoam trademark and approximately matching the physical properties Ethafoam™ 220, 400, 600 and 900 as disclosed in their respective product information sheets, which product information sheets are hereby incorporated herein by reference. Other suitable foams include CelluPlank brand foam sold by Sealed Air Corporation.

Various diameters tube and rod (i.e. solid) targets were also tested. Targets were tested by installing them on a peg of a vertical stand such as that shown in FIG. 6 and cutting them with rising and falling, left and right diagonal and horizontal cuts using one-handed and two-handed swords and daggers of different styles.

For comparison purposes, similar tests were also performed on tatami omote targets made to have similar exterior dimensions as that of the foam cutting targets. Tatami omote targets were soaked in water for 20 hours prior to cutting and, when cut, had a specific gravity of approximately 0.5 to 0.75.

Test cuts were made to simulate the two extremes of an edged weapons cut. The first extreme, "chopping," refers to a cut that is made with little or no significant movement of the cutting edge of the blade perpendicular to the direction of the cut. That is, the motion of the sword at the point of contact with target was almost entirely directly into the target. For chopping cuts, the target is cleaved by the pure force of impact with no cutting being caused by sawing action of the blade.

The second extreme, "slashing," refers to a cut in which, upon initial contact with the target and throughout the cut the sword edge has significant perpendicular motion relative to the direction of the cut. As the amount of perpendicular motion, or draw, was increased the slashing became more important than the chopping force. Slashing cuts cleave the target both because of the impact force but also because of the sawing action of drawing the edge of blade across the target material during the cut.

The testing determined that the relatively low mass of the foam cutting targets was not the cause of poor cutting properties. Rather, the testing determined that the relatively low mass of polyethylene as a target material could be compensated for by increasing the rigidity of the target and positively fixing the target to the stand. In this way, the force of a chopping cut could be effectively delivered to the target, without the target bending significantly in response to the parallel chopping force. Essentially, the chopping force of the cut was transmitted to the stand via the target's rigidity and positive attachment to the stand, as opposed to the chopping force being absorbed by the mass of the target as occurs in the traditional target materials.

The testing further identified several unexpected properties of the foam cutting material, especially the previously untested 2.2 pcf density material, that makes 2.2 pcf foam very suitable for use in targets. First, as the density of the PE foam material increases, the rigidity increases greatly while tear strength and shear strength increase only marginally. While targets made solely of 1.7 pcf foam rods having diameters less that 6 inches were too flexible to make good targets, targets made of 2.2 pcf foam rods modeled the performance of similar diameter tatami omote targets very well. Based on the testing, 2.2 pcf foam cutting targets having diameters of 2 inches or greater made excellent targets, and more particularly, 2.2 pcf foam rods having a diameter of 3 inches or greater made targets that very closely reflected the properties of tatami omote targets.

Another unexpected property of the higher density foam material was an increasingly positive attachment (with the increasing density) of the foam material provided to the stand via contact with a peg. In tests using a wooden peg with 1 inch diameter, tube targets with an inner diameter of approximately 0.75 inches were flexible enough to be easily penetrated by the peg, but also provided such a positive attachment to the peg that significantly more force was required to remove the target from the peg than could be exhibited on the target during a cut. Tests were also conducted with rods in which the peg was driven into the target. These tests also showed that the friction between the foam body and the tightness of the contact resulted in an extremely strong attachment that could easily withstand the forces of a rising cut without any observable movement of the target relative to the peg during cutting.

While lower density (i.e., 1.7 pcf foam) exhibited a positive attachment to stand pegs, that material was prone to fail and tear away at the peg when cut for targets of less than 4 inches in diameter. This problem was also encountered at larger diameters (for lower density targets), but to a lesser degree. The added strength of the higher density material reduced and, in most cases, eliminated this problem. The higher density foam also exhibited a stronger attachment with a plain wooden peg than the lower density foam did. With a 2.2 pcf foam cutting target firmly fixed to a heavy cutting stand via the peg, in effect the mass of the cutting stand is transmitted to the target, in part because of the increased rigidity of the 2.2 pcf foam.

Testing showed that increasing rigidity resulted in suitable targets only if the targets could be fixedly coupled with the mass of the cutting stand. Without the positive attachment of the foam material to the cutting stand, the foam cutting targets because of their relatively light weight were prone to being lifted from the stand during a cut. In fact, it was determined that foam cutting targets, even 1.7 pcf foam tubes were better targets for rising cuts than tatami omote targets, although still somewhat prone to tearing away at the peg if the rising cut had a significant horizontal vector (i.e. cuts that were less than 45 degrees from horizontal) for the stand configuration used. While the tatami omote targets were prone to lift off the stand when cut with a rising cut (in effect, the cut only required a upward force equal to the mass of the tatami target to lift the target off the peg), the positive attachment of the foam cutting tubes to the stand required substantially more force to lift the foam tubes from the stand and therefore resulted in the foam tubes being more capable of receiving upward forces without separating from the stand.

Testing also determined that rigidity could be increased several other ways, without increasing the density, possibly enough to compensate for the flexibility of the 1.7 pcf density foam cutting target and further improving the performance of all foam cutting targets regardless of density. First, rigidity could be increased by using rod targets rather tube targets. Testing further showed that rod targets that were forced onto a pointed peg of the cutting stand, were more rigid and exhibited a more positive attachment to the stand than otherwise identical tube targets. In addition, it was further determined that rod targets provided with a peg retention hole appropriately sized (i.e. 0.5 to 0.75 inch diameter retention hole for a 1.0 inch peg for foam cutting targets greater than 2 pcf) to receive the peg exhibited almost exactly the same properties of solid rod targets and further could be more easily placed on the peg. In this case, a peg retention hole having a depth slightly greater than the expected depth of penetration of the peg and having a diameter of less than 0.8 times the diameter of the peg appears best. Additional testing of prism targets made of 2.2 pcf foam and 4.0 pcf foam proved this theory correct, with the 4.0 pcf foam being a very good test cutting material, although perhaps too difficult for beginners. Based on this information, alternative embodiments include targets made of densities up to 9 pcf, such as standard PE foam densities of 6.0 pcf and 9.5 pcf.

Second, rigidity could by increased by increasing the diameter of the foam cutting target. Both rod and tube foam cutting targets improved in performance as diameter increased (for tubes, assuming the inner diameter was held constant). Cylindrical foam cutting targets with diameters between 2 and 8 inches were tested and were found suitable for test cutting. The results indicate the targets having a diameter between 4 and 12 inches would be preferred with targets between 6 and 8 inches in diameter being most preferable.

Targets of prism shapes were also tested including targets with rectangular, square and octagonal cross-sections. It was determined that, although the targets were universally met with substantial skepticism by the testers due to their non-cylindrical shape, upon testing the shape was determined to be substantially irrelevant to the cutting experience, with targets of similar cross-sectional area but different cross-section shapes cutting with no perceived difference.

It should be noted that non-symmetrical targets like the rectangular prism target exhibited slightly different cutting properties in that they flexed slightly less when cut along their long axis relative to cutting along their short axis.

Another method of increasing rigidity that was particularly effective was wrapping the cylindrical target in a paper sheath, which was fixed to the exterior cutting surface of the target via adhesive. The adhesive bonded well to the PE foam material and the paper's higher tensile strength provided rigidity to the entire target by preventing the target from bending in a direction parallel to the central axis of the cylinder. Essentially, the PE foam cutting target surface that was bonded to the paper was prevented from expanding/bending in response to a cut by the paper's tensile strength. The fixed paper sheath then greatly strengthened the small diameter 1.7 pcf PE foam cutting targets against bending in response to the chopping forces of a cut. This allowed the force of the cut to be expended in actual cutting of material rather than in bending the target. The addition of the paper did not appear significantly alter the other cutting properties of the PE foam cutting target.

Figure 5:
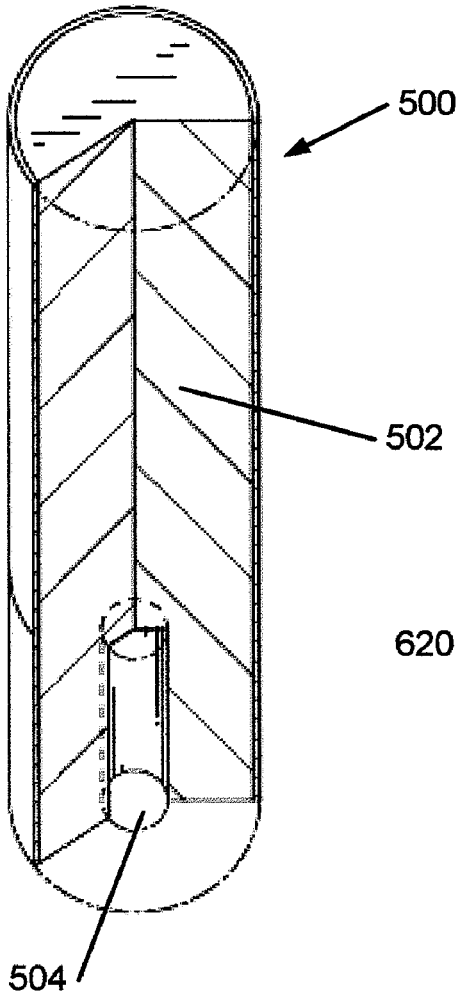
FIG. 5 shows a sectional view of an embodiment of a cylindrical cutting target with a paper sheath for added rigidity in accordance with an embodiment of the present invention.

FIG. 5 shows a cut-away perspective view of an embodiment of a cylindrical target with a paper sheath for added rigidity displaying the inside of the target. In FIG. 5, the target 500 includes a rod 502 of PE foam. At one end of the rod 502 a hole 504 has been formed to receive a peg (not shown) from the cutting stand. The hole 504 may have a circular cross section as shown or may have some other cross-sectional shape. A sheath 506 of paper covers the curved surface of the rod 502 between the two ends of the target 500. In an embodiment the sheath 506 is bonded to the rod 502 via an adhesive. Furthermore, in alternative embodiments of targets, the hole penetrates the entire length of the target, making the target more appropriately described as a tube of polyethylene.

FIG. 5 shows a cylindrical target, however, alternative embodiments are also possible and suitable for cutting. Such alternative embodiments include targets that instead of a circular cross section are long prism members having a square, triangular, rectangular, hexagonal, and octagonal cross section. Other shapes are also possible including shapes the mimic anatomical parts of humans or other animals. For example, shapes with cross pieces may be used to offer more cutting opportunities as described in U.S. patent application Ser. No. 10/769,020, which is hereby incorporated herein by reference.

Figure 6:
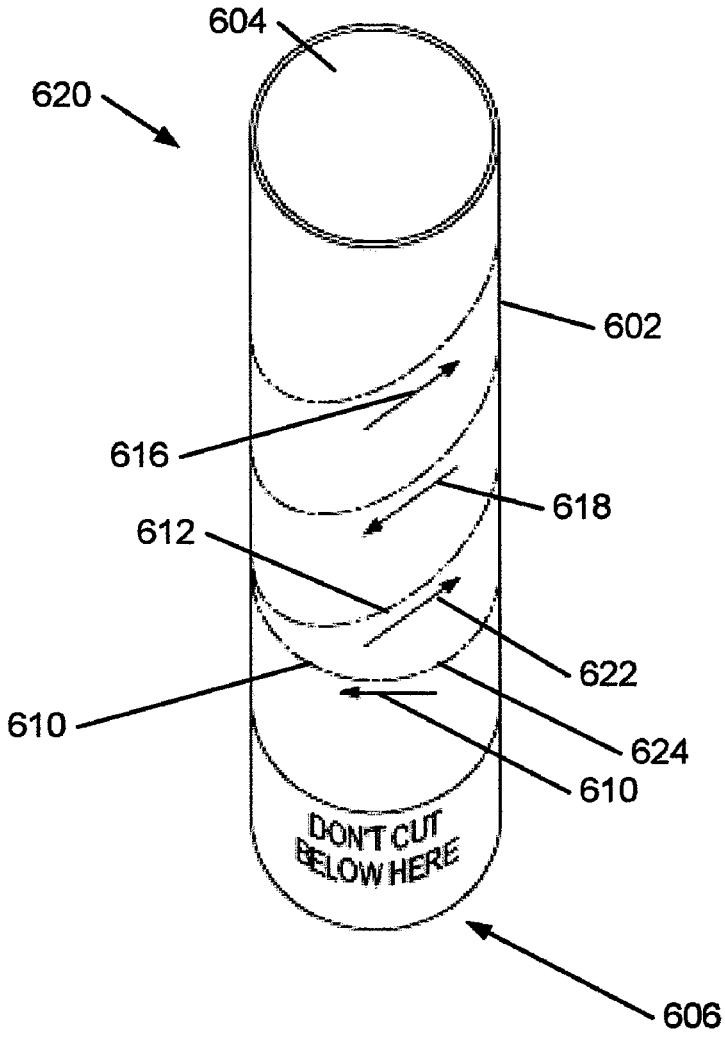
FIG. 6 shows a perspective view of a target provided with various indicia for presenting information to a user in accordance with an embodiment of the present invention.

FIG. 6 shows a perspective view of a target provided with various indicia for presenting information to a user in accordance with an embodiment of the present invention. The target 620 is a roughly cylindrical body (rod) of PE foam having a diameter, a length and a central axis. The exterior surface of the target is composed of the curved exterior wall 602 which makes up the cutting surface and two ends 604, 606, which may be flat or provided with a hole (not shown) sized to receive the peg from the stand. When provided with a hole, the hole may be cylindrical with a diameter less than the exterior diameter of the peg.

The target is provided with a visible indicia 610, such as a visible line or band 614 on the outside surface of the target's exterior as shown indicating the approximate depth of penetration of the peg into the target when the target is installed on the stand. In the embodiment shown the band 614 defines a plane that is perpendicular to the central axis of the target 620 so that regardless of the location of the practitioner the approximate depth of penetration is known. Alternative indicia include providing a different color for the engagement portion of the target 620 that is penetrated by the peg when the target is installed and, thus, unsafe to cut or warning text as shown.

Embodiments of the target may be symmetrical in that either end of the target may be designed to receive the retaining peg of the stand and, in an alternative embodiment, both ends of the target are provided with a visible indicia on the surface indicating the approximate depth of penetration into the target of the retaining peg.

In addition, the target may be provided with one or more additional indicia 610 indicating the desired location of a cut or series of cuts relative to the cutting surface. For example, as shown in FIG. 6 an indicia 616 may be provided indicating that a first cut should be made diagonally up from left to right. A second indicia 618 may then be provided indicating that a second cut should be made below the location and path of the first cut, diagonally down from right to left and a third indicia 622 is provided indicating that a third cut should be made diagonally up from left to right. A fourth indicia 622 is provided indicating a horizontal cut below the location of the second cut. Such indicia 610, 612, 616, 618, 622, may describe a predetermined series of cuts used for training practitioners in a specific school of tameshigiri such as the Shinkendo school of Japanese swordsmanship taught by Toshishiro Obata or the Toyama Ryu of Japanese swordsmanship. Such indicia 610, 612, 616, 618, 622 may consist of a simple line drawn on the surface of the target 620, of a line combined with an arrow to show the direction of the cuts (such as shown), of a shaped depression in the surface 602, of a raised section of the surface 602 or of a paper or other material attached to the surface 602.

In an alternative embodiment, circles or other shapes, possibly of different colors, may be placed on one or more surfaces in the cutting portion of the target to be used as points of aim for thrusts and cuts.

Figure 8:
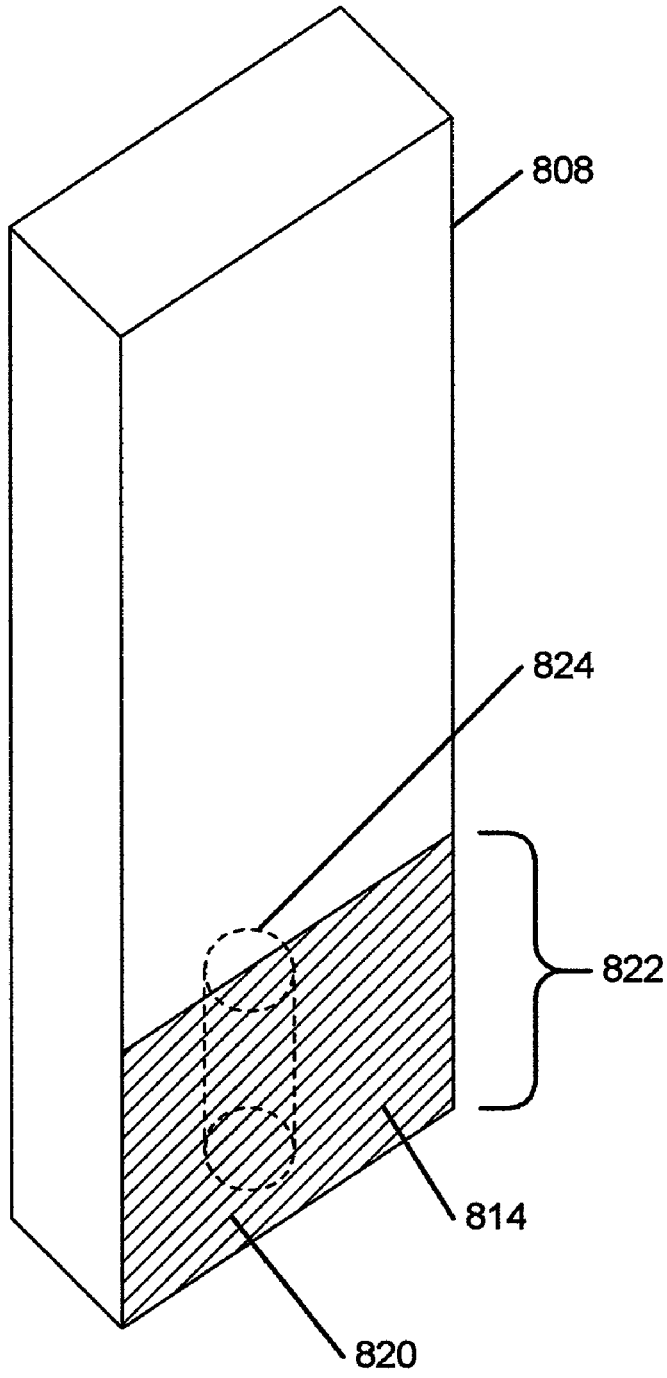
FIG. 8 is a perspective view of a rectangular prism target illustrating an embodiment of an indicia that separates the target into a cutting portion and an engagement portion.
Figure 9:
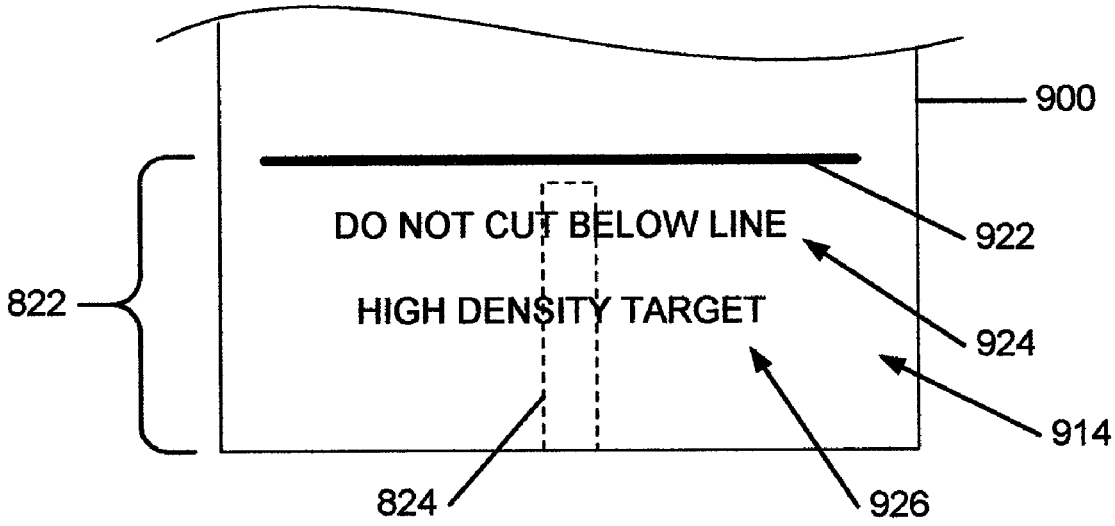
FIG. 9 is a plan view of the side of a portion of a target 900 illustrating another embodiment of an indicia identifying to the user the cutting portion and engagement portion of the target.

FIGS. 8 and 9 illustrate embodiments of different indicia on a rectangular prism target 808. FIG. 8 is a perspective view of a rectangular prism target 808 illustrating an indicia 814 that is a colored band 820 on one end of the target illustrating an unsafe region 822 to cut through when the target is installed with a peg (not shown) in the peg-receiving hole 824. The colored band 820 may also be colored to indicate the relative density of the target and/or contain text that identifies the relative density.

FIG. 9 is a plan view of the side of a portion of a target 900 illustrating another embodiment of an indicia 914. The indicia 914 includes a line 922 on a face of the target 900 and text 924 indicating a safety warning to the practitioner not to cut the below the line 922, thereby indicating that the portion 822 of the target 900 is unsafe to cut. Note that the line 922 does not exactly correlate with the depth that the peg-receiving hole 824 penetrates into the target body. This allows for an extra margin of safety. The indicia 914 may also includes text that identifies the relative density of the target with respect to other targets.

Targets with different densities were may be distinguished using a density indicia. In one embodiment, different density targets may be made of different colored foam. Thus, a lower density target appropriate for students and beginners could be made of a foam of one color, such as white, while targets of a higher density suitable for experts could be made of another color, such as yellow or green. While this is simple, it may also add to the cost of the target. Alternatively, the indicia identifying the cutting and the engagement portions of the target could be made of different colors. In yet another embodiment, different density foams may be visually distinguishable from the surface texture—the surface texture then acting as the density indicia. In yet another embodiment, a label or text on surfaces of the target may be provided identifying the relative density of the target to other targets of different density.

Density indicia is particularly useful when selling the targets in mixed sets and provided in a single box or shipment. For example, a mixed set of five low density targets and five higher density targets could be sold as a group and the buyer would be immediately aware that the targets were different based on the different density indicia. This would enhance the safety of the practice, especially if the targets are otherwise indistinguishable when taken out of the box or compared side by side at a later. Such a kit may also include one or more pegs specifically sized to engage the holes in the targets.

Improved Peg for Use with Foam Cutting Targets

Figure 2:
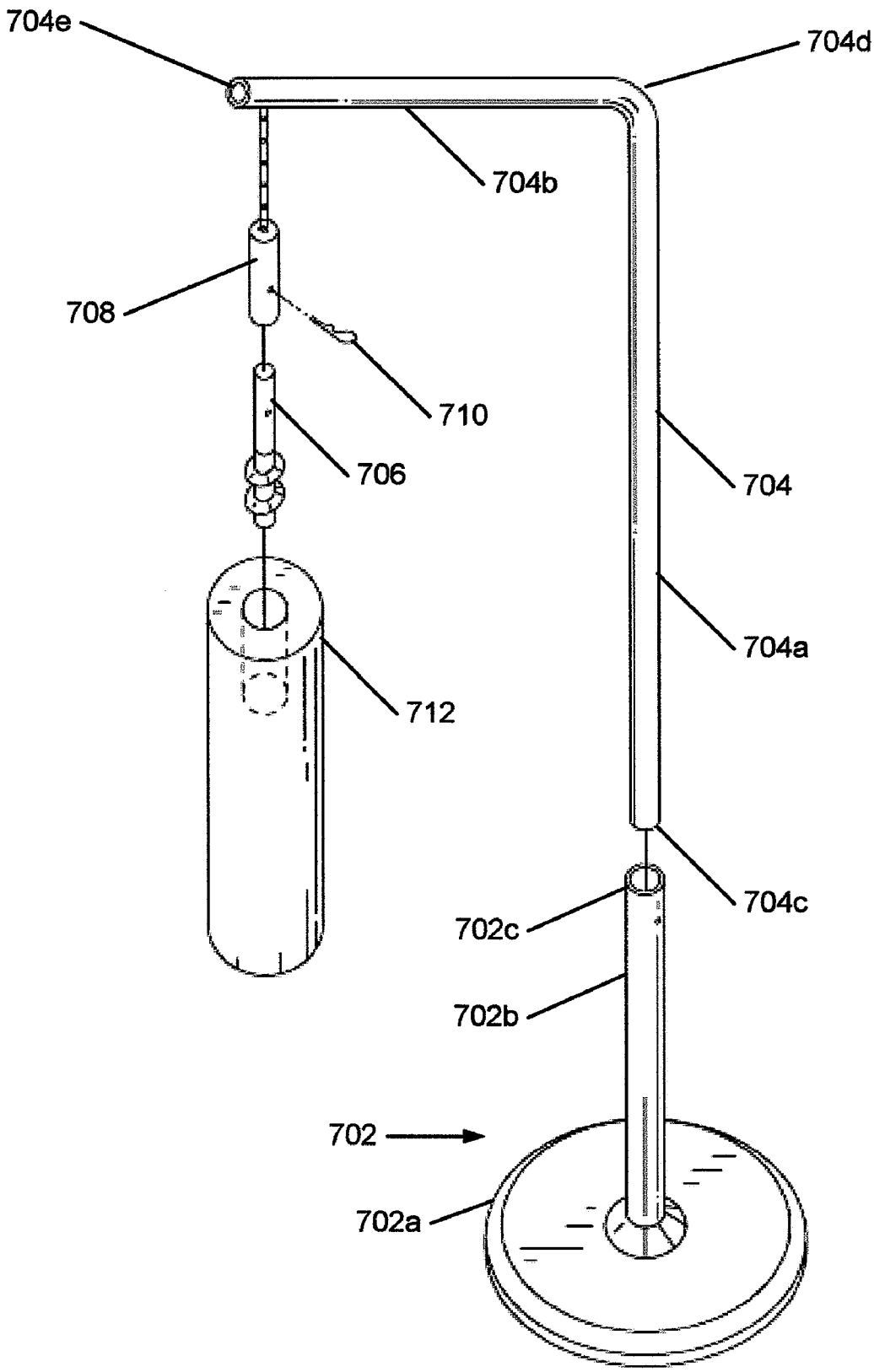
FIG. 2 shows a perspective view of another embodiment of a vertical tameshigiri stand for holding test-cutting targets in accordance with an embodiment of the present invention.
Figure 3:
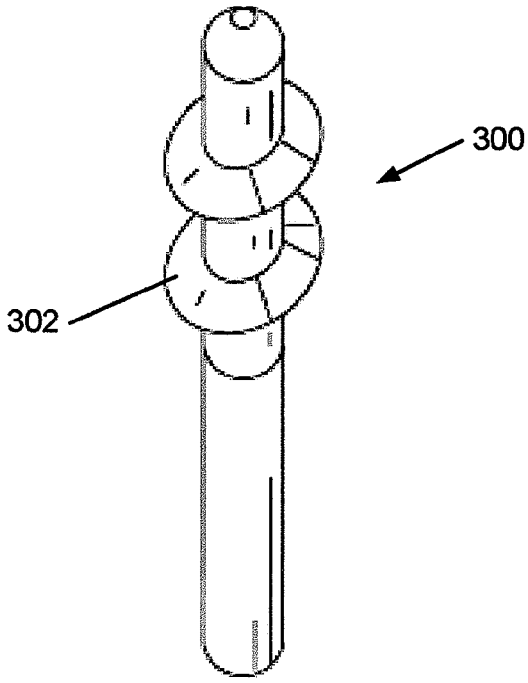
FIG. 3 shows a perspective view of an embodiment of an improved peg for use with a cutting target in accordance with another embodiment of the present invention.
Figure 4:
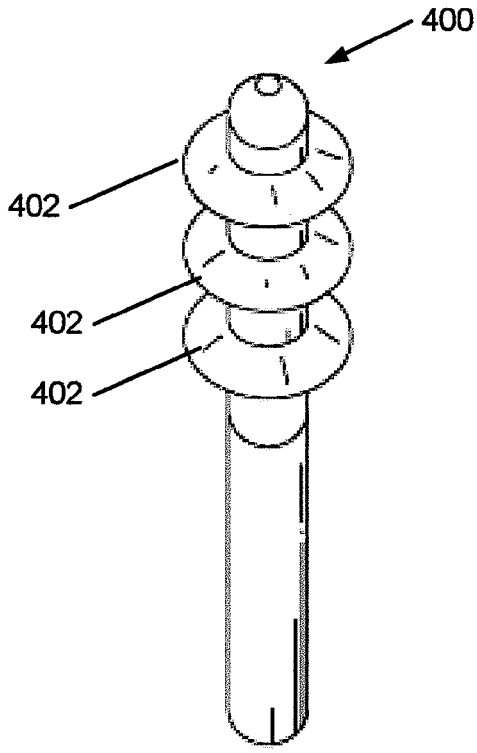
FIG. 4 shows a perspective view of an alternative embodiment of an improved peg for use with a cutting target in accordance with another embodiment of the present invention.

FIGS. 3 and 4 show perspective views of two alternative embodiments of an improved peg for use with a cutting target in accordance with another embodiment of the present invention. FIG. 3 shows an improved peg 300 and FIG. 4 shows an alternative embodiment of an improved peg 400. The improved pegs 300, 400 are disposable and designed to positively engage with a foam cutting target. The pegs 300, 400 may be removably mounted to a cutting stand, such as those shown in FIGS. 1 and 2, and should be made of a material, such as wood, that is stiff and strong, but would damage a weapon as little as possible in case of being inadvertently struck during a cut. In FIG. 3, a first embodiment of a peg 300 is provided with course threads 302, like a screw, for allowing a PE foam cutting target to be screwed onto and off of the peg would provides an even more positive attachment for the PE foam cutting targets. The threads 302 may be only slightly raised from the surface and, for PE foam cutting targets, should not extend more than 0.25 inches from the exterior wall of the peg 300.

In FIG. 4, the peg 400 is an alternative embodiment that is provided with ribs 402 which also provide extremely positive attachment points. The ribs 402 may be only slightly raised from the surface and, for PE foam cutting targets, should not extend more than 0.25 inches from the exterior wall of the peg 400.

In another embodiment (not shown) a smooth peg covered by a rubber-like coating was used. The rubber coating notably improved the retention of the PE foam cutting targets to the peg but had no effect on the retention of the tatami targets.

Improved Stands for Use with Cutting Targets

FIG. 2 shows a perspective view of a different vertical tameshigiri stand 700 for holding test-cutting targets in accordance with another embodiment of the present invention. The stand 700 includes a base portion 702. In the embodiment shown, the base portion 702 is a one piece construction having a circular, horizontal plate 702*a* for resting on the ground, from which a cylindrical vertical member 702*b* extends at approximately a right angle. It is contemplated that this base portion 702 would be made of metal, thereby providing a significant amount of weight. The vertical member 702*b* may be a tube or otherwise may be provided with a hole 702*c* for receiving a peg. In this case, the base portion 702 may be used alone as a vertical stand.

The stand 700 is also provided with an extension member 704. The extension member 704 includes a vertical member portion 704*a*, in this case a tube with an outer diameter that is less than the inner diameter of the hole 702*c* in the vertical member 702*b* of the base 702. One end 704*c* of the vertical member portion 704*a* is designed to be received by the vertical member 702*b* of the base portion 702. In this way, the extension member portion 704*a* may be placed on the vertical member 702*b* of the base portion 702 as shown in the exploded view. When set up, gravity will hold the extension member 704 on the base portion 702. In an embodiment, additional fixation devices are provided to positively fix the extension member portion 704*a* to the vertical member 702*b*.

The extension member 704 also includes a second member 704*b* at the second end 704*d* of the vertical member portion 704*a*. The second member 704*b* is attached at one end 704*d* so that it extends radially away from the vertical member portion 704*a*. The second member 704*b* may be a member that extends perpendicularly away from the vertical member portion 704*a* or may extend away at some other angle relative to the vertical member 704*a*.

At the distal end 704*e* of the second member 704*b*, an attachment device 708 is provided for attaching a peg 706 to the extension member 704. In the embodiment shown, the attachment device 708 may include a flexible member such as a length of chain (as shown) or a length of rope attached to a tube sized to receive the peg 706. In the embodiment shown, the peg and the tube have holes allowing the insertion of a cotter pin or retention pin 710 as shown. From the peg 706, a cutting target 712 may be hung suspended over the ground.

EXAMPLES

Cylindrical Foam Targets

In testing, PE foam cylindrical cutting targets of densities between 1.5 pcf and 2.2 pcf were tested. The targets varied in diameters from 2 inches to 6 inches and had a length between 24 and 72 inches each. PE foam was used because it has substantially uniform cutting properties in all directions, as opposed to tatami that has different cutting properties depending on the relative angle between the angle of the cut and the orientation of the separate, parallel stands of straw of the mat. That is, even though the foam is a closed cell foam containing voids, on a macro scale it exhibits a uniform resistance to cutting regardless of the direction of the cut through the foam.

A testing of small diameter targets made entirely of 1.7 pcf PE found that this material, while it exhibits the similar cutting properties in shear strength and tear resistance to that of the traditional tatami omote targets, was too light and too flexible to be cut with anything but a slashing cut with exceptional draw. The tatami omote, because of the weight of the water absorbed by the material, did not bounce or move much in response to a chopping cut. A chopping cut on small diameter PE foam cutting targets of the 1.7 pcf density often resulted in the target bending or bouncing away from the cut. Such movement relative to the impact point often resulted in the target being torn in two and showing only a little actual cutting of the target.

This result also occurred for slashing cuts, but to a lesser extent. As the amount of perpendicular motion, or draw, was increased in the slashing cuts, the 1.7 pcf targets could be successfully cut cleanly through, but the cloven target pieces exhibited a "scooped" cut profile indicating that the target bent during the cut. Interestingly, small diameter cloven tatami omote targets also exhibited scooped profiles showing that they also bent at least somewhat in response to the chopping cuts. Targets made of PE foam cutting tubes, due to the central aperture, exhibited more flexibility than rods, are required a commensurate increase in draw to cut cleanly when compared to PE foam cutting rods of similar diameters.

Testing determined that 2.2 pcf PE foam cutting rod targets, provided with a 0.5-0.65 inch retention hole and with a diameter of 3 inches was roughly equivalent to a half tatami mat target when cutting. Testing further determined that a 2.2 pcf PE foam cutting rod target, provided with a 0.5-0.65 inch retention hole and with a diameter of 4 inches was roughly equivalent to between a single tatami mat target and a two tatami mat target when cutting.

Diameters of 3.0 to 6.0 were tested and all suitable for slicing cuts, regardless of density. In a 2.2 pcf target, targets having about a 4.0 to 6.0 inch diameter were preferred based on responses to chopping cuts.

Testing further determined that a 2.2 pcf PE foam cutting rod target, provided with a 0.5-0.65 inch retention hole and with a diameter of 6 inches was roughly equivalent to between a two tatami mat target and a three tatami mat target when cutting. The 4.0 inch and greater diameters made the best targets in terms of flex and responsiveness to both chopping and slicing cuts. It was further determined that higher densities of PE foam could also make excellent targets. Based on these experiments, PE foam targets with a density of about 2 pcf or greater with diameters of 3 inches and greater make good targets that emulate the cutting experience of tatami. Targets of PE foam having a density between about 1.8 pcf and 9.0 pcf are preferred, between about 2.0 pcf to 6 pcf being more preferred and between about 2.2 pcf to 4 pcf most preferred.

Approximately 15 targets of 1.7 pcf PE foam wrapped in adhesive-backed paper were cut. The targets varied in size from about 2 inches in diameter to 5 inches. The fixed paper sheath then greatly strengthened the small diameter 1.7 pcf PE foam cutting targets against bending in response to the chopping forces of a cut. This allowed the force of the cut to be expended in actual cutting of material rather than in bending the target. The addition of the paper did not appear significantly alter the other cutting propertied of the PE foam cutting target. However, the adhesive from the paper tended to stick to the blades of the swords causing the blades to cut poorly in subsequent cuts unless the blades were completely cleaned between cuts. From the test, it was determined that PE foam cutting targets with greater than 1.5 pcf density would be suitable if sheathed by paper as described.

Prism Foam Targets

In testing, PE foam rectangular prism cutting targets of densities between 2.2 pcf and 4.0 pcf were tested. The targets tested were of three cross-sectional sizes: 2-inch wide by 2-inch deep (2×2); 2-inch by 4-inch (2×4); and 2-inch by 8-inch. Targets of varying lengths were tested, but primarily targets of having a length of two and three feet were tested. These targets were made of Sealed Air Corporation's CelluPlank® 220 and 400 extruded polyethylene foams.

This testing was performed to determine if the prism shape was detrimental to cutting and to verify that the 4.0 pcf density was cuttable. The exterior sides of the prism targets were substantially flat, but not perfectly flat, in that the surfaces exhibited a roughness due to the closed cell foam and slight variations from the extrusion process.

In testing, it was determined that the shape of the target appeared to have little or no discernable effect on the cutting. A testing of small cross-section (2×2) targets made of 2.2 pcf PE found that this material, while it exhibits the similar cutting properties in shear strength and tear resistance to that of the traditional tatami omote targets, was too light and too flexible to be cut with anything but a slashing cut with exceptional draw. The larger cross-section of 2×4 and 4×4 were more rigid due to the size and were adequately cuttable.

Testing of the higher, 4.0 pcf, density targets showed that the higher density target was more rigid and therefore less likely to bounce away from a cut. The increase in density was also very noticeable and the 4.0 pcf density target was definitely a more difficult target to cut through, requiring more force, in addition to a good draw, by the practitioner.

In side by side testing against soaked tatami targets, the 2×4 target of 4.0 pcf PE foam was generally considered roughly equivalent to a target made of two tatami mats.

In testing, it was further determined that 2×4 and greater size cross-sections of 4.0 pcf and 2.2 pcf foam were suitable for cutting without any exterior sheath, such as the paper sheath 506 shown in FIG. 5.

I claim:

1. A test-cutting target for cutting with edged weapons comprising:

a rectangular prism of foam having a density greater than about 2.0 pounds per cubic foot and less than about 9.0 pounds per cubic foot, the prism having a first end, a second end and four exterior surfaces between the first and second ends, the four exterior surfaces having a first length;

wherein the prism is divided into a cutting portion and a first engagement portion by a first indicia on at least one of the four exterior surfaces;

wherein the first indicia indicates the approximate depth of penetration of a retaining peg into the target when the target is attached to a test-cutting stand, thereby indicating to a practitioner where on the target it is unsafe to cut;

a first hole penetrating the first engagement portion of the prism at approximately the center of the first end of the target, the hole having a circular cross section and extending for a second length into the target, the second length being less than the first length, the hole for receiving and firmly engaging the peg; and wherein the first indicia is located at approximately the second length from the first end of the target.

2. The test-cutting target of claim 1 further comprising a second hole in the second end that penetrates the prism in a second engagement portion for at least the second length into the target; and a second indicia on at least one exterior surface near the second end indicating the maximum penetration by the peg when the second end engages the peg, the second indicia identifying the second engagement portion of the prism to the practitioner.

3. A test-cutting target for cutting with edged weapons comprising:

a unitary body of polyethylene foam having a density greater than about 2.0 pounds per cubic foot and less than about 9.0 pounds per cubic foot, the body having a first length and a first end, a second end and one or more exterior surfaces between the first and second ends, the body divided into a solid cutting section and an engagement section by a first indicia;

wherein the first end is adapted to removably attach to a test-cutting stand;

wherein the body includes a visible indicator indicative of the test-cutting target's density;

wherein the first indicia is on only one exterior surface near the first end indicating the approximate location of a retaining peg in the body when the target and the peg are fully engaged, thereby visually indicating to a practitioner where on the body it is unsafe to cut;

wherein the body is a prism having at least three exterior surfaces between the first and second ends, each of the at least three exterior surfaces being substantially flat.

4. The test-cutting target of claim 3 further comprising:

a void penetrating the engagement section of the body, the void located at approximately the center of the first end, the void extending for a second length into the body, the second length being less than the first length, the void sized for receiving and firmly engaging a peg on the test-cutting stand, and wherein the first indicia is located on the only one exterior surface at a location based on the second length.

5. The test-cutting target of claim 3 wherein the visible indicator is text on the only one exterior surface.

6. The test-cutting target of claim 3 wherein the visible indicator is selected from one or more of text, surface texture, and foam color.

7. The test-cutting target of claim 4 wherein the void is cylindrically shaped and has a diameter smaller than a width of the retaining peg and, when engaged with the retaining peg, is fixed to the peg via friction between the body and the retaining peg.

8. The test-cutting target of claim 3 further comprising:

a plurality of third indicia on at least one of the at least three exterior surfaces, each third indicia indicating a preferred location for striking the test-cutting target with a weapon.

9. A test-cutting target for cutting with edged weapons comprising:

a rectangular prism of foam having a first end, a second end and four exterior surfaces between the first and second ends, at least one of the four exterior surfaces having a first length;

wherein the prism is divided into a cutting portion and a first engagement portion by a first indicia on at least one of the four exterior surfaces;

wherein the first indicia indicates the approximate depth of penetration of a retaining peg into the target when the target is attached to a test-cutting stand;

a first hole penetrating the first engagement portion of the prism, the hole having a circular cross section and extending for a second length into the target, the second length being less than the first length, the hole for receiving and firmly engaging the peg; and wherein the first indicia is located at approximately the second length from the first end of the target.

10. The test-cutting target of claim 9 further comprising:

a plurality of third indicia on at least one of the four exterior surfaces in the cutting portion of the target, each third indicia providing a different point of aim for a cut or thrust to the target.

11. The test-cutting target of claim 9, wherein the rectangular prism of foam comprises at least two pieces of foam laminated together.

12. The test-cutting target of claim 11, wherein at least one of the at least two pieces of foam has a different density than the other pieces of foam.

13. The test-cutting target of claim 9, wherein the rectangular prism of foam is a unitary piece of extruded foam.

14. The test-cutting target of claim 9, wherein the foam is a polyethylene foam.

* * * * *